US005765745A

United States Patent [19]

Graziano

[11] Patent Number: 5,765,745

[45] Date of Patent: Jun. 16, 1998

[54] SECURED MESSAGE POSTCARD MAILER AND METHOD OF MANUFACTURE

[76] Inventor: Earl N. Graziano, 6645-10 E. Redmont Dr., Mesa, Ariz. 85215

[21] Appl. No.: 588,597

[22] Filed: Jan. 18, 1996

[51] Int. Cl.[6] ..... B42D 15/00

[52] U.S. Cl. ..... 229/92.8; 283/95; 283/100

[58] Field of Search ..... 229/92.8; 283/95, 283/100, 102

[56] References Cited

U.S. PATENT DOCUMENTS 4,742,954 5/1988 Shishido ..... 283/100

5,001,749 3/1991 Iggulden et al. ..... 283/17

*Primary Examiner*—Stephen P. Garbe

*Attorney, Agent, or Firm*—Parsons & Goltry; Robert A. Parsons; Michael W. Goltry

[57] ABSTRACT

A secured message postcard mailer having a message area defined on a front surface of a postcard and covered by an obscuring layer to prevent viewing of a message in the message area, the message being imprintable within the message area through the obscuring layer by thermal electronic impulses provided by a thermal printing apparatus.

2 Claims, 2 Drawing Sheets

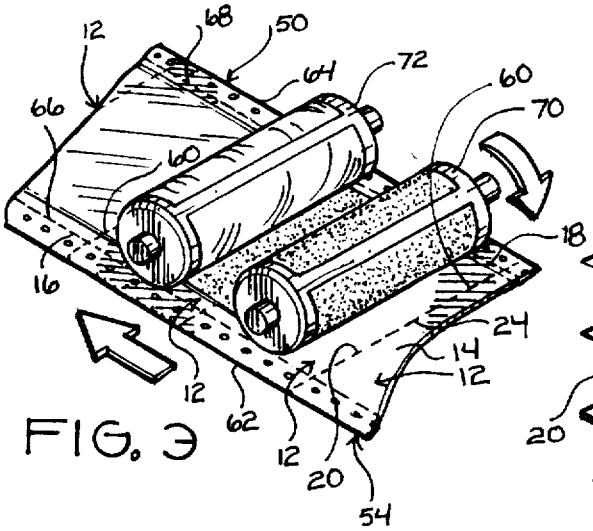
FIG. 3
FIG. 4
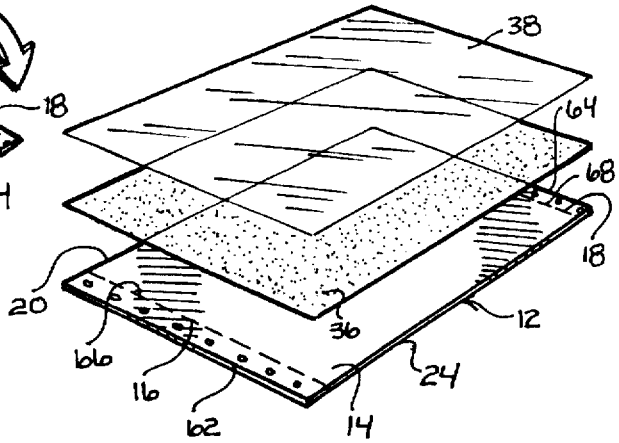
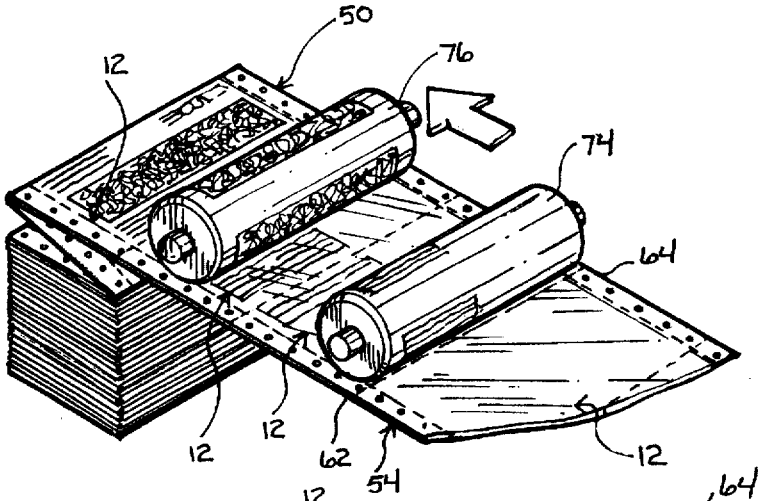
FIG. 5
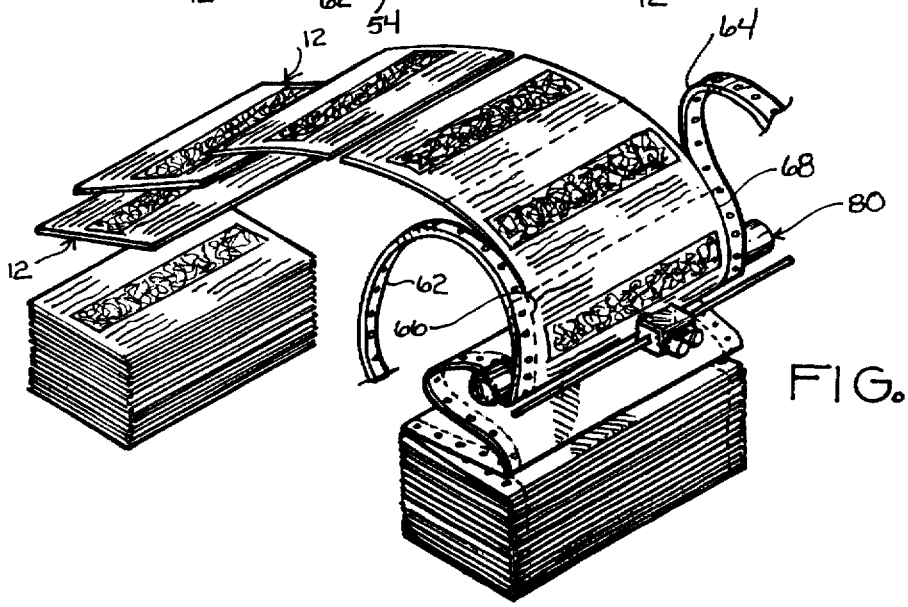
FIG. 6

SECURED MESSAGE POSTCARD MAILER AND METHOD OF MANUFACTURE

BACKGROUND OF THE INVENTION

1. Field of the Invention

This invention relates to postcard mailers.

More particularly, this invention relates to postcard mailers having a message securing attachment, and method of manufacture.

2. Prior Art

Postal services have long been used to deliver messages, even confidential messages. Typically, a sealed envelope is employed which contains and conceals the message. While envelopes have long been used to conceal confidential messages, the continuing increase of postal rates is making bulk mailing of first class mail prohibitively expensive. Many businesses send a great deal of information to clients through the mail, much of which is confidential.

To overcome this problem, many businesses engaging in bulk mailings are using postcards to convey necessary information to clients. While greatly reducing mailing costs, a traditional postcard cannot be used to convey confidential material since anyone with access to the card is able to read the message.

Many businesses, banks for example, send out a great deal of confidential material such as pin numbers for bank cards. It is imperative that this information remain confidential. However, banks send out a great deal of this information, and with the increasing postal rates, the use of first class mail is becoming prohibitively expensive.

Currently, to overcome this problem, a postcard is now in use which uses a reliable adhesive to bond a privacy label over the message. To view the message the person receiving the postcard peels the label off, exposing the message. While this privacy label is somewhat effective in preventing confidential material from being viewed, it has drawbacks in that it is not securely attached to the postcard. While in transit or during processing, the privacy label may be accidentally removed or partially removed, with the covered information being visible. This will raise some questions as to whether anybody has actually viewed the confidential material accidentally or with intent, or if the privacy label was accidentally peeled off.

It would be highly advantageous, therefore, to remedy the foregoing and other deficiencies inherent in the prior art.

Accordingly, it is an object of the present invention to provide a new and improved postcard and method of manufacture.

Another object of the present invention is to provide a message securing attachment which covers a message.

And another object of the present invention is to provide a secure message postcard which is relatively inexpensive.

A further object of the present invention is to provide a secured message postcard mailer which cannot be accidentally opened.

And a further object of the present invention is to provide a secure postcard mailer having self imaging properties allowing secret information to be imprinted thereon using a thermal printer.

Yet another object of the present invention is to provide a postcard mailer which may have a secret message concealed by a scratch off or rub off cover.

And yet another object of the present invention is to provide a method of manufacturing a secure message postcard mailer.

SUMMARY OF THE INVENTION

Briefly, to achieve the desired objects of the instant invention in accordance with a preferred embodiment thereof, provided is a secured message postcard mailer comprising a base sheet having a front surface and a message area defined on the front surface, an imprinting medium overlying the message area. The imprinting medium includes a thermal sensitive chemical coating covering the front surface of the base sheet corresponding to the message area, and the obscuring layer is separated from the chemical coating by a substantially transparent protective layer. The obscuring layer is preferably an opaque, scratch-off layer covering the protective layer, and obscuring the message area.

BRIEF DESCRIPTION OF THE DRAWINGS

The foregoing and further and more specific objects and advantages of the instant invention will become readily apparent to those skilled in the art from the following detailed description of preferred embodiments thereof taken in conjunction with the drawings in which:

FIG. 3 is a perspective view illustrating the fabrication of a continuous sheet of the postcard mailers of FIG. 1 and FIG. 2;

FIG. 4 is an exploded perspective view of a base stock material used in combination with the instant invention;

FIG. 5 is a view very similar to the view of FIG. 3;

FIG. 6 is a perspective view illustrating the use of a continuous sheet of postcard mailers.

DETAILED DESCRIPTION OF THE PREFERRED EMBODIMENT

Figure 1:
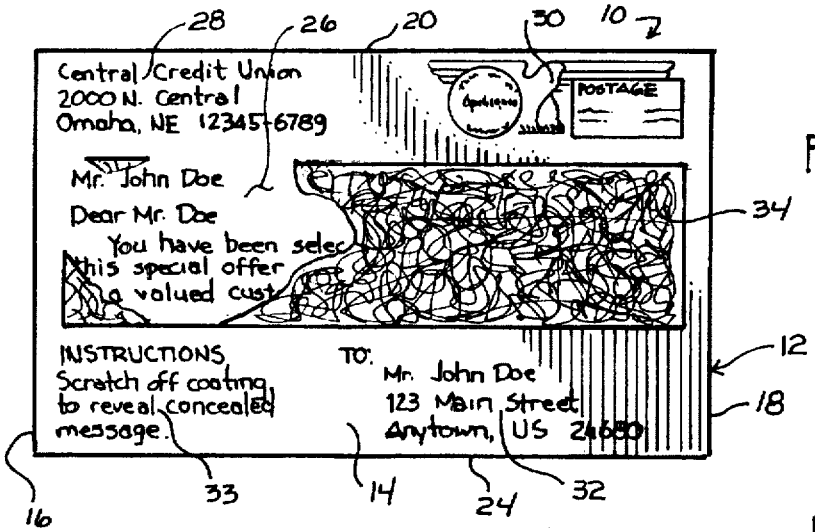
FIG. 1 is a top view of an embodiment of the instant invention constructed in accordance with the preferred embodiment, the embodiment comprising a secured message postcard mailer as it would appear ready for mailing, with a portion removed to display the secured message.

Turning now to the drawings, in which like reference characters indicate corresponding elements throughout the several views, attention is first directed to FIG. 1 which illustrates a first embodiment of the instant invention comprising a secured message postcard mailer generally designated by the reference character 10. Secured message postcard mailer 10 consists of a substantially rectangular base sheet 12 having a front surface 14, a back surface (not visible) opposite front surface 14, opposed axial edges 16 and 18, and opposed longitudinal edges 20 and 24. In this embodiment, base sheet 12 is 4¼ inches by 6 inches. These are dimensions accepted by the United States Post Office as postcards, but could vary in size depending upon differing size requirements needed to be met. Secured message postcard mailer 10 has a message area 26 defined on front surface 14 extending longitudinally across the medial portion of front surface 14 between axial edges 16 and 18. A return address area 28 is defined on front surface 14 above message area 26, adjacent longitudinal edge 20 and axial edge 16. A postage area 30 is located above message area 26 adjacent longitudinal edge 20 and axial edge 18. An address area 32 is located below message area 26 adjacent longitudinal edge 24 and axial edge 18, and an instruction area 33 is located below message area 26 adjacent longitudinal edge 24 and axial edge 16. It will be understood that these various areas are located in traditional positions for purposes of illustration and that these positions may be altered as desired.

The message printed in message area 26 is covered by an obscuring layer 34. Obscuring layer 34 is preferably a layer of material which is rubbed or scratched off to reveal the underlying message, and will be described in more detail below.

Figure 2:
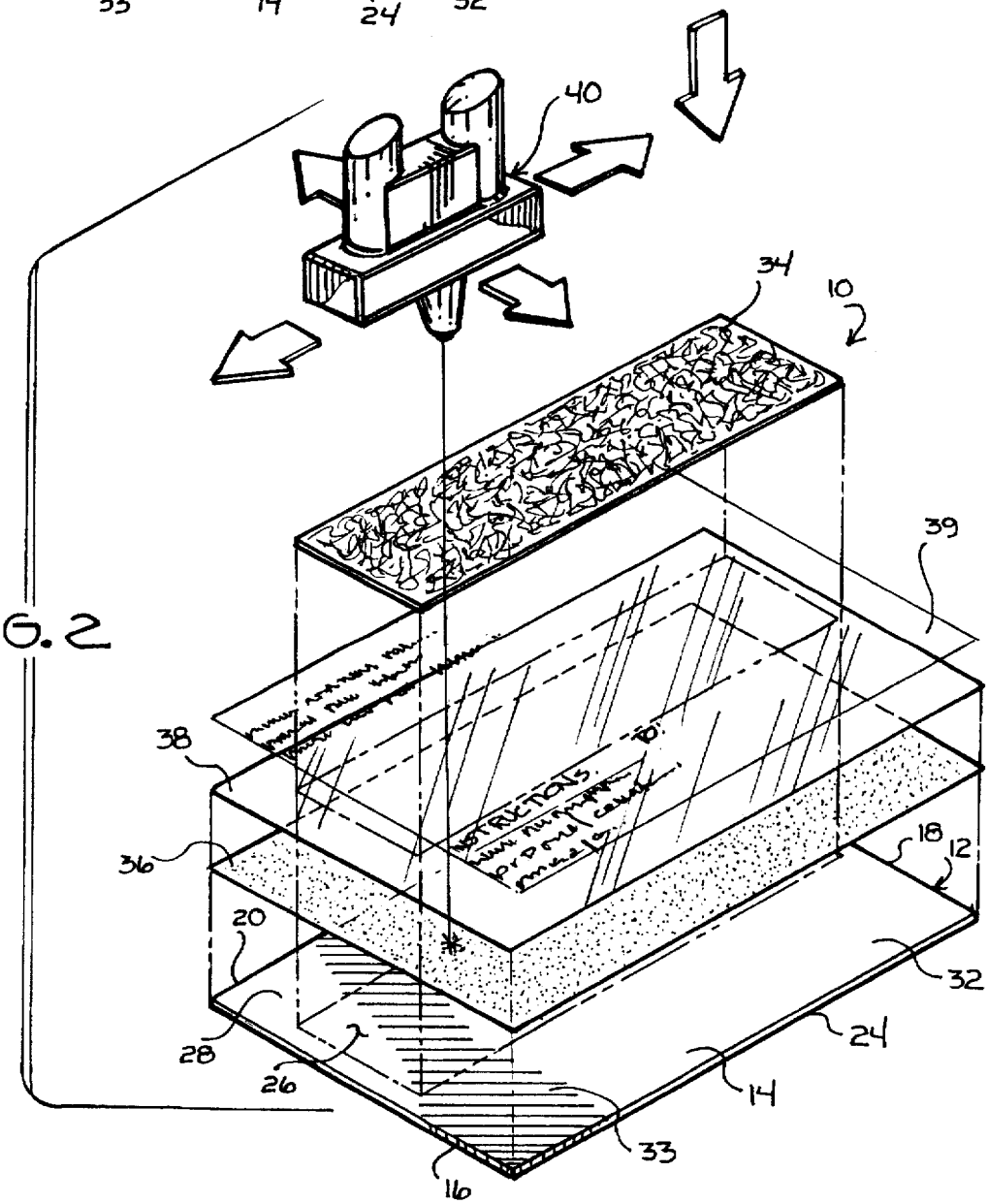
FIG. 2 is an exploded perspective view of the secured message postcard mailer first depicted in combination with FIG. 1, and further illustrating portions of a thermal printer providing a message upon portions of the secured message postcard mailer.

Turning now to FIG. 2 and to FIG. 4, postcard mailer 10 includes an imprinting medium for forming messages in message area 26 and address area 32. In this embodiment, the imprinting medium is a chemical coating 36 on front surface 14 overlying substantially the entire front surface 14 of base sheet 12. A protective layer 38 overlays substantially the entire area of the chemical coating 36, print indicia layer 31) overlays instruction area 33 and return address area 2P, obscuring layer 34 overlays message area 26, chemical coating 36, and the portions of the protective layer 38 overlaying message area 26. Base sheet 12 is a card stock or a paper stock called "optima thermal paper" manufactured by Appleton Papers, Inc., Appleton, Wisconsin. Chemical coating 36 is a thermal coating which activates by electronic heat impulses such as that provided from ceramic head 40 of a conventional thermal printer (not herein specifically shown). Thermal printers, such as that manufactured by Monarch Marking, Co., Dayton, Ohio, are well known and they emit high temperature electronic impulses through the ceramic head 40 which activates the thermal coating on the base stock 12 leaving a permanent image. Specifically, indicia is imprinted under the chemical,coating 36 in response to the electronic heat impulses, which is captured and remains permanently etched onto portions of the front surface 14 of base sheet 12 proximate message area 26.

Protective layer 38 is preferably a transparent material separating obscuring layer 34 from chemical coating 36 and through which a message in message area 26 can be viewed. In this embodiment, protective layer 38 is a clear imprintable overprint varnish such as manufactured by Algan, Inc. of Chagrin Falls, Ohio. Obscuring layer 34 overlays message area 26, chemical coating 36, and protective layer 38, preventing viewing of any message formed in message area 26. In this embodiment, obscuring layer 34 is preferably an opaque heat resistant scratch-off or rub-off ink or chemical coating such as that available from Nor-Cote, Co., of Crawfordsville, Ind., which is commonly referred to as "silk screen coating". Protective layer 38 permits obscuring layer 34 to be rubbed or scratched off without damaging chemical coating 36.

Postcard mailer 10 may be used individually, with a address being imprinted onto base sheet 12 and a message being imprinted onto base sheet 12 using a thermal printer. While postcard mailer 10 may be used individually, the preferred method is for a continuous sheet of postcard mailers to be provided and used in combination with a thermal printer. In this manner many postcard mailers 10 can be prepared for mailing quickly and easily. Referring to FIG. 3, formation of a plurality of base sheets 12 in a continuous sheet 50, is illustrated. Continuous sheet 50 is formed by providing a continuous length of base sheet material 54. Continuous length of base sheet material 54 consists of a plurality of base sheets 12 joined along adjacent longitudinal edges 20, and 24. Each base sheet is separable along a perforation 60 between adjacent longitudinal edges 20 and 24. Guide hole strips 62 and 64 are coupled to axial edges 16 and 18 respectively, and are removable along perforations 66 and 68 therebetween.

With continuing reference to FIG. 3, and additional reference to FIG. 5, continuous length of the base sheet material 54 is prepared by a series of rollers consisting of a chemical roller 70, coating the chemical coating 36 onto front surface 14 of each base sheet 12, and a protective roller 72, applying protective layer 38. Continuous length of base sheet material 54 is printed upon by means of offset printing. A print roller 74 prints the designated areas, seen as print indicia layer 39 illustrated in combination with FIG. 2, onto each base sheet 12. Then, an obscuring roller 76 operates for applying obscuring layer 34.

In use, as illustrated in FIG. 6, continuous sheet 50 is fed into thermal printing device 80, which prints the desired message and address onto each postcard mailer. The thermal electronic impulses activates the thermal coating transferring the message to the front surface 14 of the base sheet 12 as described previously. Guide strips 62 and 64 are removed along perforations 66 and 68 respectively, and then separated along perforations 60 for individual mailing. The message on each postcard mailer 10 is obscured and cannot be accidentally viewed. In order to view the message, obscuring layer 34 must be removed from protective layer 38. This requires an affirmative action such as rubbing or scratching.

Various changes and modifications to the embodiment herein chosen for purposes of illustration will readily occur to those skilled in the art. To the extent that such modifications and variations do not depart from the spirit of the invention, they are intended to be included within the scope thereof which is assessed only by a fair interpretation of the following claims.

Having fully described the invention in such clear and concise terms as to enable those skilled in the art to understand and practice the same, the invention claimed is:

1. A continuous sheet of secured message postcard mailers comprising:

a plurality of base sheets each having;
- a front surface,
- opposed axial edges,
- opposed longitudinal edges, and
- a message area defined on said front surface, a thermal sensitive chemical coating covering said front surface of said base sheet corresponding to said message area;

an obscuring layer overlying and covering said imprinting medium and said message area of each of said plurality of base sheets and separated from said chemical coating by a substantially transparent protective layer, the obscuring layer including an opaque, scratch-off layer covering said protective layer, and obscuring said message area; and perforations formed between said adjacent longitudinal edges for separation into individual secured message postcard mailers; and a guide hole strip attached to each axial edge, and separable from said axial edge along a perforation.

2. A secured message postcard mailer comprising:

a base sheet having;
- a front surface,
- opposed axial edges,
- opposed longitudinal edges, and
- a message area defined on said front surface, an imprinting medium including a thermal sensitive chemical coating covering said front surface of said base sheet corresponding to said message area; and an obscuring layer overlying and covering said imprinting medium and said message area of said base sheet and separated from said chemical coating by a substantially transparent protective layer, the obscuring layer including an opaque, scratch-off or rub-off layer covering said protective layer, and obscuring said message area.

* * * * *